United States Patent [19]

Hulsing

[11] 4,213,564

[45] Jul. 22, 1980

[54] FUEL INJECTOR

[76] Inventor: Kenneth L. Hulsing, 12619 Beacon Hill Ct., Plymouth, Mich. 48170

[21] Appl. No.: 925,070

[22] Filed: Jul. 17, 1978

[51] Int. Cl.[2] ..... F02M 47/02

[52] U.S. Cl. ..... 239/88; 123/445; 239/533.4; 239/533.6

[58] Field of Search ..... 239/533.3–533.9, 239/533.11, 533.12, 453, 88, 90; 123/139 AK, 139 AT

[56] References Cited

U.S. PATENT DOCUMENTS

| | | | |
|---|---|---|---|
| 1,898,325 | 2/1933 | Venn | 239/453 |
| 2,035,203 | 3/1936 | Smith | 239/533.6 |
| 2,255,203 | 9/1941 | Wiegand | 239/533.3 |
| 2,762,654 | 9/1956 | Purchas, Jr. | 239/90 |
| 2,962,227 | 11/1960 | Whitehurst | 239/533.4 |
| 3,982,693 | 9/1976 | Hulsing | 239/533.4 |

FOREIGN PATENT DOCUMENTS

| | | | |
|---|---|---|---|
| 163396 | 5/1958 | Sweden | 239/533.3 |
| 447743 | 3/1935 | United Kingdom | 239/533.11 |

*Primary Examiner*—Robert B. Reeves
*Assistant Examiner*—Michael J. Forman
*Attorney, Agent, or Firm*—Reising, Ethington, Barnard

[57] ABSTRACT

A plunger valve nozzle for mounting vertically in an engine cylinder head between two closely spaced vertical poppet valves in said head, said nozzle having a small diameter body at its lower end, said body having a bore extending vertically therethrough, a plunger valve slidably fitting said bore, a plunger valve retracting rod extending above and connected at its lower end to said plunger valve, a coil spring connected to the upper end of said rod, and an elongated annular housing supporting said body and spring, said housing having a tubular like lower portion enclosing said rod and a larger diameter upper portion enclosing said spring the outside diameter of said lower housing portion being substantially the same as that of said body.

7 Claims, 7 Drawing Figures

FUEL INJECTOR

TECHNICAL FIELD

This invention relates to nozzles of the plunger valve controlled type for injecting liquid fuel under pressure into an engine cylinder, and particularly such nozzles for small engines.

BACKGROUND ART

In my prior U.S. patent application, Ser. No. 866,595, filed Jan. 3, 1978, I disclosed a plunger valve nozzle which, particularly for small engines, embodied several important advantages over then known nozzles of this type such as represented by my prior U.S. Pat. No. 3,982,693. Included among those advantages as set forth in said prior patent application were the use of a direct acting piston type plunger valve, a constant diameter bore nozzle body and axial pressure fluid flow from the spring chamber to the plunger valve.

DISCLOSURE OF THE INVENTION

The nozzle of my present invention, while retaining each of those advantageous features, embodies additional unique design concepts which considerably reduce both the overall diameter of the parts which protude into the engine cylinder, and the nozzle manufacturing cost. For example, whereas the nozzle of said prior patent application contemplated an opening therefor in the engine cylinder head in the order of $\frac{3}{8}$ to $\frac{5}{8}$ inches diameter and a plunger valve diameter in the order of 3/32 inches, the nozzle constructed in accordance with this invention requires a cylinder head opening in the order of only 5/16 inches diameter and its plunger valve diameter may be correspondingly reduced to the order of only 1/16 of an inch.

This considerable reduction in diameter has the important advantages of minimizing heat flow to the nozzle by reason of its smaller area exposed to the engine combustion gases, enabling location of the nozzle vertically in the cylinder head between the valves for optimum fuel dispersion, and enabling use of larger size valves adjacent the nozzle for increased engine breathing capability.

The cylinder head opening required for the nozzle in accordance with my present invention need only be of the diameter of the nozzle body since the nozzle body supporting means employed is in the form of an elongated annular housing having a tubular like depending portion, and only this depending portion and the nozzle body which is secured to the lower end thereof projects into the cylinder head. The spring chamber of the nozzle is located in a counterbore in the upper end of this housing, and the tubular like depending portion of the housing serves both to enclose the plunger valve retracting rod and to conduct the fuel from the spring chamber to the plunger valve in the nozzle body.

When used in a separate pump and nozzle system the supply of pressure fuel may be either through a side port in the upper portion of the housing or axially thereof through a supply pipe clamped to the upper end of the housing. In the latter arrangement an anti-blowback valve may be located in the counterbore between the end of the supply pipe and the upper end of the plunger valve retracting rod. Alternatively the upper end of the housing may be clamped to the lower end of the pumping chamber bushing of a jerk type pump, to provide a unit injector. In this latter arrangement the lower end of the bushing may serve as the closure seat for the anti-blowback valve.

Important cost savings are also achieved by the present invention since the single housing which supports the nozzle body takes the place of the separate upper and lower body members and the spacer member used therefor in the plunger valve nozzle of my aforementioned prior patent application. Securement of the nozzle body to the housing is very simply effected by providing a counterbore in the lower end of the housing to receive a reduced diameter upper end portion of the nozzle body, and welding the two together at their juncture.

It is accordingly the principal object of my invention to provide a plunger valve nozzle for small engines which minimizes both the area thereof exposed to combustion gases and the combustion space required therefor in relation to that available for engine valve openings, achieves important savings in cost of manufacture, and which with minimal alteration of its housing upper end can be direct coupled to a jerk type pump for operation as a unit injector.

The best modes for carrying out the invention will now be described with reference to the accompanying drawings.

BEST MODES FOR CARRYING OUT THE INVENTION

Figure 1:
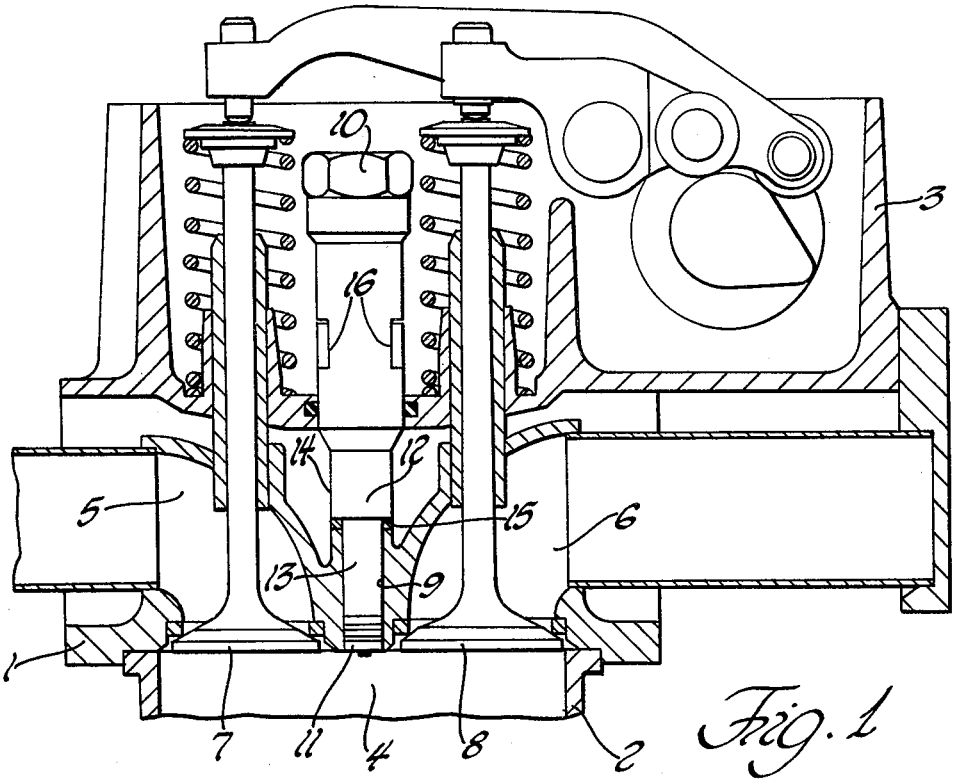
FIG. 1 is a vertical sectional view of the upper portion of a valve-in-head engine including, in elevation, a plunger valve nozzle in accordance with my invention shown extending vertically through the cylinder head between two poppet valves.

Referring now to the drawings, and first to FIG. 1, the upper portion of a diesel engine is shown, including the cylinder head 1 which is held clamped to the upper end of the cylinder 2 by a head supporting member 3, the cylinder being fitted with a conventional piston (not shown) which cooperates with the cylinder head to define a combustion chamber 4 in which a mixture of air and liquid fuel is burned to effectuate operation of the engine. The air required for combustion may be introduced through one of two cylinder head ports 5 and 6, and following each power stroke of the piston the spent combustion gases are discharged through the other of said ports. Opening and closing of these ports is controlled in timed relation with engine operation by the exhaust valves 7 and 8, respectively. Extending through an opening 9 in the cylinder head 2, between these valves, is a plunger valve nozzle 10 for spraying liquid fuel at high pressure into the combustion chamber 4 to initiate the combustion process.

Figure 2:
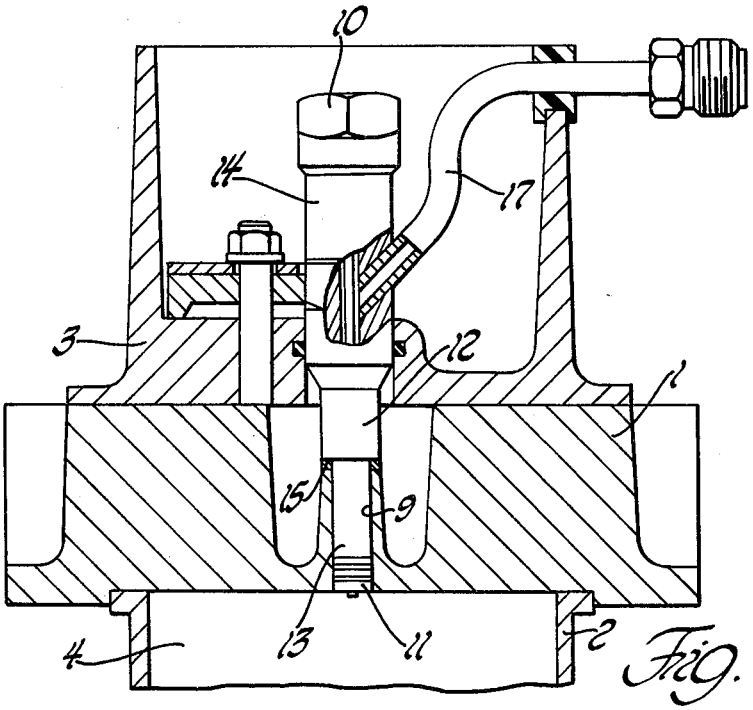
FIG. 2 is a vertical sectional view of the engine, taken perpendicularly to that of FIG. 1, showing a portion of the valve nozle broken away and its connection through a side port therein to a pressure fuel supply pipe.

This plunger valve nozzle, which is constructed in accordance with the invention, has a nozzle body 11 at its lower end (i.e. its combustion chamber end) and an elongated annular housing 12 which extends upwardly from and supports the nozzle body in the cylinder head opening 9. The lower portion 13 of the housing is of the same outside diameter as the nozzle body, and only it and the nozzle body occupy the cylinder head opening 9. The upper portion 14 of the housing, which is of larger diameter, is shown radially supported in the cylinder head supporting member 3, and at the juncture between these two portions of the housing is a shoulder 15 which abuts the cylinder head 1 at the upper end of the opening 9 therein. As best seen in FIG. 2, the plunger valve nozzle may be held in position by a conventional crab 16, and high pressure fuel from an injection pump (not shown) may be supplied to the plunger valve nozzle by a feed pipe 17 connected to a side port in the upper portion 14 of the housing.

Figure 3:
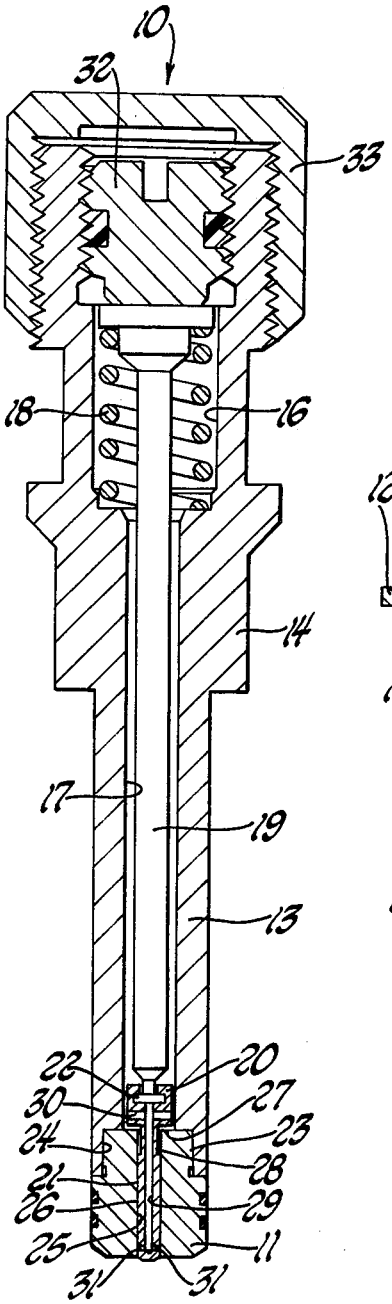
FIG. 3 is an enlarged view in vertical section of the plunger valve nozzle of FIGS. 1 and 2, shown removed from the engine.

Referring now to FIG. 3, it will be seen that the lower portion 13 of the housing 12 is generally tubular like in configuration and depends downwardly from the larger upper portion 14 which is counterbored to provide a spring chamber 16 coaxial with the passage 17 extending longitudinally through the housing lower portion. A coil spring 18 has its lower end seated in the spring chamber, and the upper end of this spring resiliently supports the flanged upper end of a rod 19 which is of smaller diameter than the passage 17 and has its lower end joined in end-to-end relation to the upper end 20 of a plunger valve 21 by a conventional horseshoe type joint 22. The nozzle body 11 has its upper portion 23 formed with a reduced outside diameter which fits and seats within a counterbore 24 provided in the lower end of the housing portion 13, and a secure interconnection of these two parts is achieved by welding their axially abutting surfaces together.

Extending centrally through the nozzle body is a constant diameter bore 25 whose upper end is in open fluid pressure communication with the passage 17 in the housing, and the plunger valve has a direct acting piston portion 26 which has a close sliding fit in this bore 25. The upper end face 27 of the nozzle body surrounding the bore 25 underlies the plunger valve upper end 20, which is of larger diameter than the piston portion, and serves as a shoulder to limit downward travel of the plunger and rod 19. Intermediate its piston portion and enlarged upper end 20 the plunger valve is provided with a reduced section 28 which subjects the piston portion at all times to the fluid pressure existing in the housing passage 17. The plunger valve also has an internal passage 29 extending longitudinally thereof, which is in open communication at all times with the housing passage 17 via a cross hole 30 drilled through the plunger upper end and which is connected to the outer periphery of the piston portion near the lower end thereof by a plurality of small travsversely drilled spray orifices 31. Limiting upward movement of the plunger valve and rod is an adjustable stop member 32, shown in the form of a plug screwed into the upper end of housing 12 above the spring chamber 16. A closure cap 33 is also shown screw threaded onto the upper end of the housing.

Normally the spring 18 maintains the rod in abutment with the stop member 32, in which position the rod holds the plunger valve retracted in the nozzle body where the spray orifices are above the lower end face 34 of the nozzle body and are thus closed by the bore 25. However, upon the fuel supplied to the interior of the housing being raised to a predetermined pressure, the spring yields to allow the plunger valve to descend in the bore a sufficient distance that the spray orifices are uncovered by the lower end of the bore and the high pressure fuel is sprayed out below the nozzle body end face 34 and into the combustion chamber 4 (FIGS. 1 and 2) where it mixes with highly compressed air and ignites.

It will be appreciated that by having to provide space between the engine valves 7, 8 and their ports 5, 6 for only the nozzle body and the depending tubular like lower portion 13 of its supporting housing, and locating the larger portion of the housing containing the spring chamber 16 well above the combustion chamber, it enables the use of two relatively large valves in the cylinder head of even a small engine. Also, since these parts of the plunger valve nozzle need only be of small diameter, not only is the heat flow into the nozzle minimized by reason of the small area exposed to the engine combustion gases, but their small diameter enables locating the nozzle vertically and centrally of the combustion chamber for equal dispersion of fuel in all directions.

Figure 4:
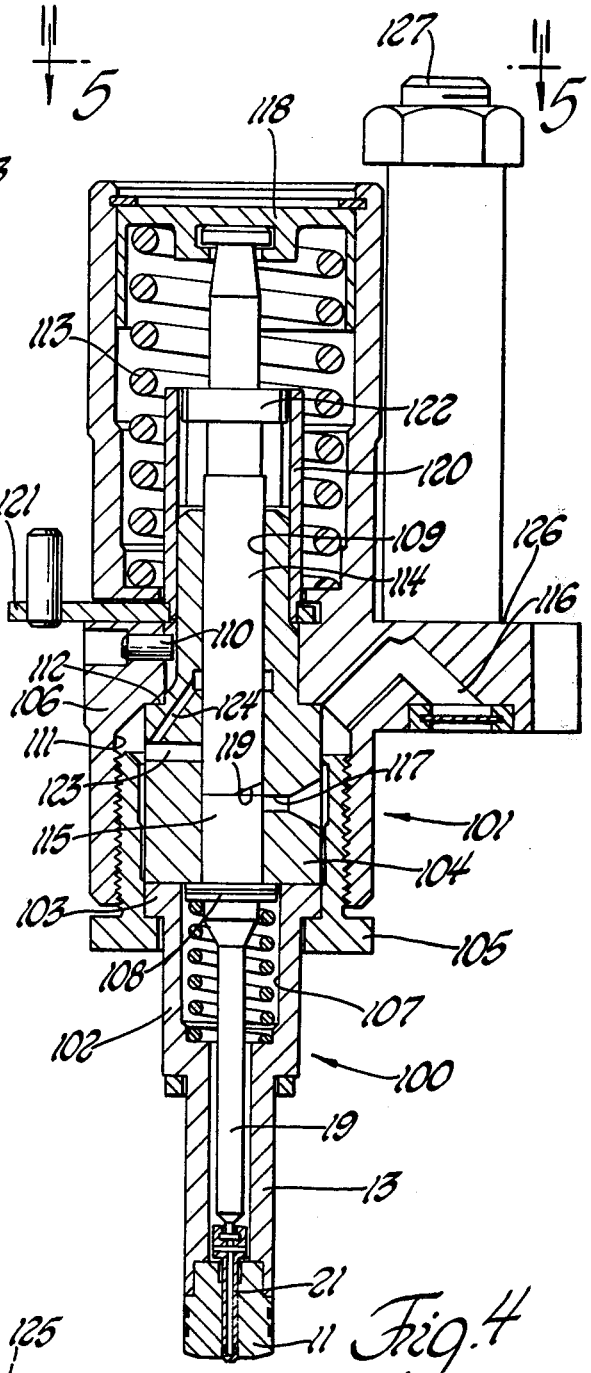
FIG. 4 is a vertical sectional view of a unit injector embodying a slightly different form of my plunger valve nozzle.

FIG. 4 shows a slightly modified form of my plunger valve nozzle 100, direct coupled to a jerk type pump 101 for operation as a unit injector. Only the upper housing portion 102 of this plunger valve nozzle is modified from that previously described with reference to FIGS. 1–3, the important differences being that its upper end has an external flange 103 which is clamped against the lower end of the bushing 104 of the pump by a gland nut 105 screwed into the lower end of the pump casing 106, and the counterbore 107 extends a short distance above the flanged upper end of the plunger valve retracting rod 19 to provide space between the latter and the pump bushing for insertion of an anti-blowback or check valve 108. This check valve 108 is generally plate shaped so as to seat against the lower end of the pump bushing 104 and thus block escape of engine combustion chamber gases into the bushing in the event the plunger valve 21 should fail to return from its open position in the nozzle body 11.

Figure 5:
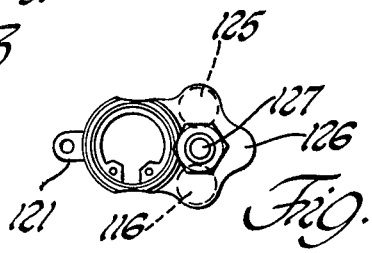
FIG. 5 is a reduced elevational showing of the unit injector of FIG. 4, as viewed in the direction of the arrows 5—5 in FIG. 4.

The pump casing 106 has a bore 109 intermediate its upper and lower ends which radially supports the bushing and in which the bushing is locked against axial rotation by a pin 110 inserted in the side of the casing. A counterbore 111 in the lower end of the casing is internally threaded to receive the nut 105, and the bushing has an upwardly facing shoulder 112 intermediate its ends which seats in this counterbore. The casing also has a counterbore in its upper end in which a coil spring 113 is seated, and connected to the upper end of this spring is a pump plunger 114 having a close sliding fit in the bushing 104. The interior of the bushing below the pump plunger forms a pumping chamber 115 in which fuel pressure is developed for opening the plunger valve nozzle 100. Fuel from a supply pump (not shown) is delivered to this pumping chamber via a passage 116 in the casing which is connected through the counterbore 11 to a side port 117 in the bushing. Downward movement of the pump plunger against the biasing force of the spring 113 is produced by an engine driven rocker (not shown), operable against the spring retainer 118 which overlies the upper end of the pump plunger. When the lower end of the pump plunger moves down far enough to close the port 117 fuel pressure builds up rapidly in the pump chamber and within the nozzle housing to that required to move the plunger valve downwardly to its open position against the biasing force of the plunger valve spring 18. So that the start of such pressure build-up, as well as the quantity of fuel to be injected per stroke of the pump plunger, may be varied, the lower end of pump plunger is formed with a helix 119 and the pump plunger is adjustably rotatable within the bushing 104. Such rotative adjustment is provided by a sleeve 120 which is journalled on the bushing, the lower end of this sleeve being keyed to a control arm 121 which extends laterally outward of the pump casing and its upper end being keyed to a collar 122 on the pump plunger. Such leakage fuel as escapes past the pump plunger from the pumping chamber 115 is conducted through other ports 123 and 124 in the bushing to the counterbore 111, from which it is returned to the supply pump via a second passage 125 (FIG. 5) in the casing. Both the casing passages 116 and 125 are located in a laterally extending boss 126 which may be secured to the engine cylinder head support by a mounting stud 127.

Figure 6:
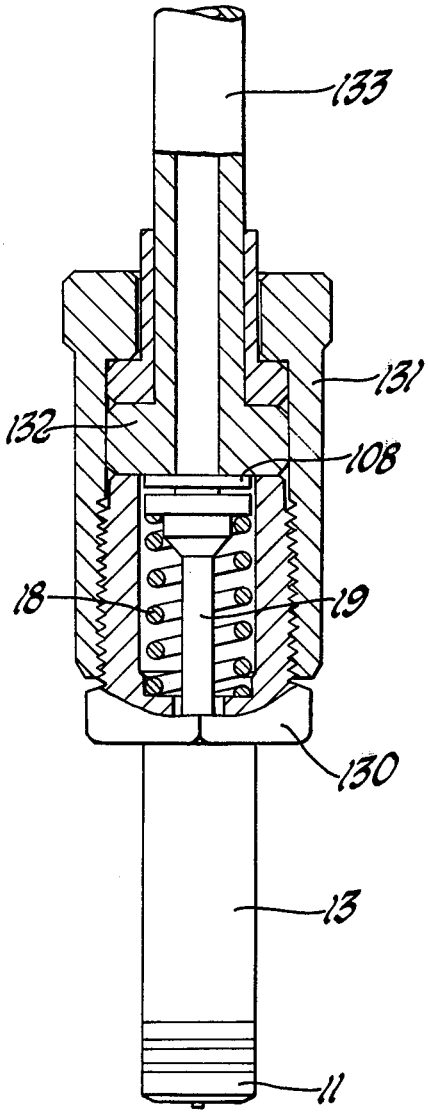
FIG. 6 is an enlarged elevational view of my plunger valve nozzle, with parts broken away in section to show modifications thereof to provide axial pressure fuel supply and the addition of an anti-blowback valve at the upper end of the nozzle body supporting housing.
Figure 7:
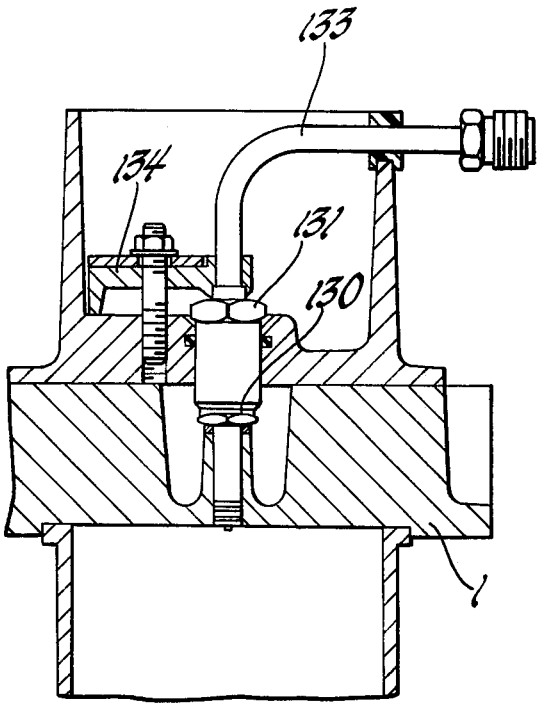
FIG. 7 is an elevational view showing the plunger valve nozzle of FIG. 6 installed in the engine cylinder head.

FIGS. 6 and 7 show a plunger valve nozzle similar to that of FIGS. 1 and 3, but with the fuel supply arranged axially of the nozzle housing and incorporating the anti-blowback or check valve 108 described with reference to the FIG. 4 embodiment. In this modification the upper housing portion 130 is externally threaded for engagement by an internally flanged nut 131 which clamps the externally flanged end 132 of a fuel supply pipe 133 to the upper end of the nozzle housing. This flanged end 132 of the fuel supply pipe has its lower face defining the seat for the check valve 108, in the same manner as the lower end of the bushing 104 in the FIG. 4 embodiment. The crab 134 shown in FIG. 77 is arranged to overlie the upper end of the nut 131 in holding this plunger valve nozzle seated in the cylinder head 1.

Thus it should be apparent that a plunger valve nozzle constructed in accordance with my invention not only has the advantage of greatly reducing the cross sectional area of the parts which must protrude through the cylinder head to the combustion chamber of the engine, but incorporates a housing for supporting the nozzle body whose basic design requires only minor modification of its upper end portion to adapt the nozzle for either side feed or axial feed in a separate pump and nozzle system, or for direct coupling to a jerk type pump as a unit injector.

Having shown and described what is believed are the best modes for carrying out my invention, it will be understood that various minor changes in the parts or their arrangement may be made without departing from the scope of the invention as hereinafter claimed.

What is claimed is:

1. A plunger valve nozzle for injecting fuel into an engine cylinder, said nozzle comprising an elongated annular housing having a central passage extending therethrough, means for introducing fuel under pressure to said passage, a nozzle body secured to the lower end of said housing and defining an upwardly facing shoulder within said housing passage, a counterbore in the upper end of said housing and open to said housing passage, a coil compression spring having one end seated in said counterbore, said nozzle body having a constant diameter bore extending therethrough from said shoulder, a plunger valve having a piston portion slidably fitting said bore and an enlargement extending into said housing passage above said shoulder, a plunger retracting rod spacedly disposed within and extending longitudinally of said housing passage, said rod having its upper end connected to the opposite end of said spring and its lower end connected to said plunger valve enlargement, said plunger valve having a portion of reduced cross section extending into said bore from said enlargement for exposing said piston portion to the fuel pressure within said housing passage, said piston portion having an internal passage extending longitudinally thereof and open at its upper end to said housing passage, the opposite end of said internal passage having a connecting orifice extending transversely to the periphery of the piston portion, said orifice being normally closed by said bore but said spring being yieldable in response to a predetermined fuel pressure within said housing passage to accommodate downward displacement of the plunger valve to a position in which at least a portion of said orifice is uncovered by the lower end of said bore.

2. The plunger valve nozzle of claim 1, wherein said plunger valve enlargement is abuttable with said nozzle body shoulder to limit downward displacement of the plunger valve by said fuel pressure.

3. The plunger valve nozzle of claim 1, wherein the upper end of said counterbore is internally threaded and fitted with an adjustable stop member limiting upward travel of the plunger retracting rod when said fuel pressure is relieved.

4. The plunger valve nozzle of claim 1, wherein said means comprises a fuel supply pipe clamped to the upper end of said housing and having an annular end face overlying said counterbore and the upper end of said plunger retracting rod.

5. The plunger valve nozzle of claim 4, including a generally plate shaped check valve loosely fitting said counterbore and interposed between said end face and the upper end of the plunger retracting member.

6. The plunger valve nozzle of claim 1, wherein said means comprises an injector pump having a bushing defining a pumping chamber and a plunger reciprocable in said bushing in response to engine operation, said bushing having its end below the plunger clamped to the upper end of said housing and overlying said counterbore and the upper end of said rod, a side port in the bushing above said counterbore for introducing fuel to the pumping chamber between pumping strokes of the plunger, said plunger being adjustably rotatable in said bushing and having a port closing helix on its periphery for varying the fuel pressure developed by the pump.

7. The structure set forth in claim 6, including a generally plate shaped check valve loosely fitting said counterbore and interposed between said bushing end and the upper end of said rod.

* * * * *